US006440293B2

(12) United States Patent
Morokuma et al.

(10) Patent No.: US 6,440,293 B2
(45) Date of Patent: Aug. 27, 2002

(54) ELECTRODE AND ELECTROLYTE FOR USE IN PREPARATION OF NITROGEN TRIFLUORIDE GAS, AND PREPARATION METHOD OF NITROGEN TRIFLUORIDE GAS BY USE OF THEM

(75) Inventors: Tatsuma Morokuma; Hiromi Hayashida; Akio Kikkawa, all of Yamaguchi (JP)

(73) Assignee: Mitsui Chemicals, Inc. (JP)

( * ) Notice: Subject to any disclaimer, the term of this patent is extended or adjusted under 35 U.S.C. 154(b) by 0 days.

(21) Appl. No.: 09/739,967

(22) Filed: Dec. 20, 2000

(30) Foreign Application Priority Data

Dec. 21, 1999 (JP) ..... 11-362062

(51) Int. Cl.[7] ..... C25B 1/24

(52) U.S. Cl. ..... 205/359; 205/360; 205/411; 205/491; 205/498; 205/551; 205/556; 205/617; 205/618; 205/619; 205/622; 204/247.3; 204/291; 204/292

(58) Field of Search ..... 204/247.3, 291, 204/292, 293; 205/491, 498, 551, 556, 617, 618, 619, 622, 411, 359, 360

(56) References Cited

U.S. PATENT DOCUMENTS 5,084,156 A * 1/1992 Iwanaga et al. ..... 204/247
6,010,605 A * 1/2000 Tarancon ..... 204/247

FOREIGN PATENT DOCUMENTS

JP 08-225976 9/1996

OTHER PUBLICATIONS

Database Chemabs; Chemical Abstracts Service, Columbus, Ohio, US; Tasaka, Akimasa et al: "Effect of trace elements on the electrolytic production of NF3", retrieved from STN; Database accession No. 126:244038 CA XP002167333, *abstract* & J. Electrochem. Soc. (1977), 144(1), 192–197, 1997.

Database WPI; Section Ch. Week 199629 Derwent Publications Ltd., London, GB; Class E36, AN 1996–283935 XP002165943 and JP 08 120475 A (Mitsui Toatsu Chem. Inc.), May 14, 1996, *abstract*.

Database WPI; Section Ch, Week 200019 Derwent Publications Ltd., London, GB; Class E36, AN 2000–209765 XP002165944 & JP 11 189405 A (Mitsui Petrochem Ind. Co., Ltd.), Jul. 13, 1999, *abstract*.

* cited by examiner

*Primary Examiner*—Bruce F. Bell
(74) *Attorney, Agent, or Firm*—Burns, Doane, Swecker & Mathis, L.L.P.

(57) ABSTRACT

An electrode for electrolyzing an electrolyte comprising an ammonium fluoride ($NH_4F$)-hydrogen fluoride (HF)-containing molten salt and having a composition ratio (HF/$NH_4F$) of 1 to 3 to prepare a nitrogen trifluoride ($NF_3$) gas and an electrolyte for use in the preparation of $NF_3$ gas, and a preparation method of the $NF_3$ gas by the use of the electrode and the electrolyte. The electrode comprises nickel having 0.07 wt % or less of Si content and containing a transition metal other than nickel. The electrolyte also contains a transition metal other than nickel.

9 Claims, 1 Drawing Sheet

ELECTRODE AND ELECTROLYTE FOR USE IN PREPARATION OF NITROGEN TRIFLUORIDE GAS, AND PREPARATION METHOD OF NITROGEN TRIFLUORIDE GAS BY USE OF THEM

BACKGROUND OF THE INVENTION

1. Field of the Invention

The present invention relates to an electrode and an electrolyte for use in the preparation of a nitrogen trifluoride gas, and a preparation method of the nitrogen trifluoride gas by the use of the electrode and the electrolyte.

More specifically, it relates to an electrode and an electrolyte for use in the preparation of a nitrogen trifluoride gas by the electrolysis of an ammonium fluoride ($NH_4F$)-hydrogen fluoride (HF)-containing molten salt, and a preparation method of the nitrogen trifluoride gas by the use of the above electrode and electrolyte.

2. Description of the Related Art

With the drastic advancement of electronic industries in recent years, the density and the performance of semiconductor elements have been heightened, and the production of very large-scale integrated circuits has been increased. In consequence, a high-purity nitrogen trifluoride gas has been required as a gas for dry etching for use in a preparation process of integrated circuits and as a gas for a cleaner of a CVD apparatus.

The preparation methods of the nitrogen trifluoride (hereinafter abbreviated to "$NF_3$") gas can be roughly classified into a chemical method and an electrolysis method. The chemical method comprises a first step in which a fluorine (hereinafter abbreviated to "$F_2$") gas is produced, and a second step in which the thus obtained $F_2$ gas is reacted with a raw material containing nitrogen to thereby prepare the $NF_3$ gas. On the other hand, the electrolysis method comprises preparing a non-aqueous molten salt containing nitrogen component and fluorine component as an electrolyte, and then electrolyzing the electrolyte to thereby prepare the $NF_3$ gas.

As compared with the chemical method, the electrolysis method has an advantage that the NF3 gas can be prepared in a high yield in one step.

The chemical method uses an $F_2$ raw material containing a large amount of carbon tetrafluoride (hereinafter abbreviated to "$CF_4$ "), and hence the $NF_3$ gas is inevitably contaminated with the large amount of $CF_4$. However, this $CF_4$ is extremely similar to $NF_3$ in physical properties, and in order to obtain the high-purity $NF_3$ gas, it is unavoidable to apply an advanced purification technique, which is industrially costly. On the contrary, in the electrolysis method, $CF_4$ is scarcely produced or entrained in a synthetic process, and hence, it has a merit that the high-pure $NF_3$ gas can be easily obtained.

The outline of an industrial synthesis of the $NF_3$ gas by the electrolysis method is as follows. As an electrolyte, there is used an $NH_4F$-HF molten salt comprising ammonia, acidified ammonium fluoride ($NH_4HF_2$) and anhydrous hydrogen fluoride (HF). Using an anode made of a metallic material electrolytes the above molten salt. The $NF_3$ gas is generated on the anode, thereby obtaining the $NF_3$ gas containing impurities. After a purifying operation, the purity of the $NF_3$ gas is in excess of 99.99 vol %.

The metallic material, which is most suitable for the anode, is nickel. When another metal is used, passivation occurs owing to the formation of the oxide film on the anode surface, so that current does not flow, or it is vigorously dissolved into the electrolyte. Even nickel is slightly dissolved, and hence the electrode is consumed. In consequence, in an industrial production, it is required to often replace the electrode, and it is also unavoidable to exchange the electrolyte contaminated with nickel salts produced by the dissolution.

The electrolysis method is an excellent technique for easily obtaining the high-pure nitrogen trifluoride gas, but it has been an industrially important theme to inhibit the dissolution of the anode.

For this theme, various electrode materials and electrolytes for inhibiting the dissolution of the electrode have been investigated.

SUMMARY OF THE INVENTION

The present inventors have intensively investigated the differences of dissolution behavior between nickel and other metals in order to achieve the inhibition of the dissolution. As a result, it has been found that the surface of nickel in a highly oxidative state is covered by a stable conductive oxyfluoride at the time of electrolysis in the aforementioned molten salt, and the exchange of electrons is carried out via the resultant film between the electrode and an electrolyte, so that nickel is less dissolved than the other metals, and a passivation does not occur and therefore electrolysis can be performed. It has been suggested that, for the purpose of positively promoting the production of the oxyfluoride on the surface of the electrode, an oxide of nickel is mixed with a nickel dispersed plating or a nickel powder, followed by sintering, to reduce the amount of dissolved nickel (Japanese Patent Application Laid-open No. 225976/1996). However, further intensive investigation has been conducted to seek for an easier technique, and as a result, it has been found that the amount of dissolved nickel can be reduced by controlling an Si content present in the electrode to 0.07 wt % or less, introducing a transition metal into the nickel electrode, and allowing a certain amount or more of the transition metal to exist in the electrolyte, and in consequence, the present invention has been completed.

That is to say, the present invention is directed to an electrode for electrolyzing an electrolyte comprising an ammonium fluoride ($NH_4F$)-hydrogen fluoride (HF)-containing molten salt, a composition ratio ($HF/NH_4F$) being in a range of 1 to 3, said electrode comprising nickel in which an Si content is 0.07 wt % or less, a transition metal other than nickel being added to the nickel electrode. Furthermore, it is directed to a preparation method of a nitrogen trifluoride gas by the use of the above electrode and/or the electrolyte containing a transition metal.

The method of the present invention is an epoch-making invention in which the amount of dissolved nickel can be remarkably reduced without changing a conventional electrolysis process. In consequence, the frequency of replacing the electrode or the electrolyte can be decreased to half or less of a conventional case, and cost can also be reduced. The effects of the present invention are extremely large in industrial production.

DETAILED DESCRIPTION OF THE PREFERRED EMBODIMENTS

Figure 1:
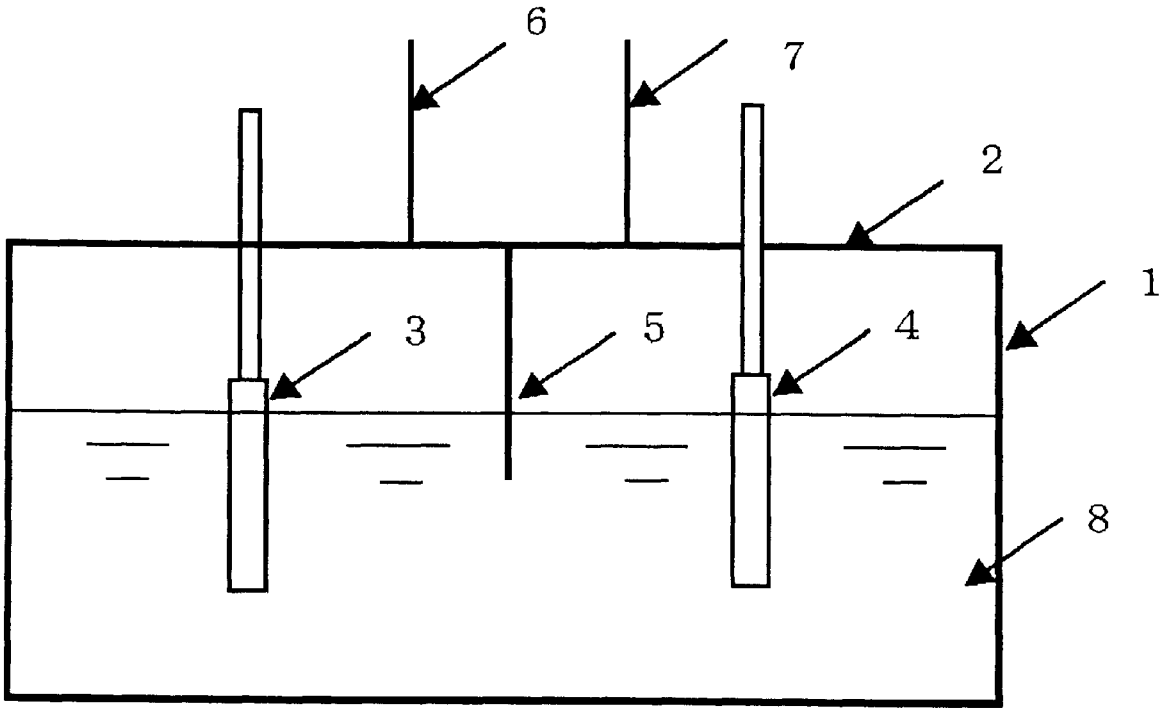
FIG. 1 is a schematic view showing one example of an electrolytic cell, which is usable in the present invention.

Next, the present invention will be described in detail.

Examples of a transition metal other than nickel, which can be used in the present invention, include first transition elements (Sc, Ti, V, Cr, Mn, Fe, Co and Cu) and second transition elements (Y, Zr, Nb, Tc, Ru, Rh, Pd and Ag) among elements in the groups IIIA to IB of the periodic table (long form), Ta, Pt and Au. In addition, oxides and peroxides, which are compounds of these transition metals, can also be used.

An electrode for use in the present invention is an alloy obtained by introducing at least one of the above transition metals into nickel and/or a nickel electrode in which an Si content is 0.07 wt % or less. The nickel to be used contains nickel as a main component, and nickel content is preferably about 90-wt % or more, more preferably 98.5-wt % or more.

Even when an extremely small amount of the transition metal is contained in the electrode, its effect can be exerted. For example, when about 0.02-wt % of Co is contained in the electrode, the dissolution amount of the anode can be decreased about 40-wt % as compared with a case where Co is not added. The increase in the amount of the transition metal to be added leads to the increase in its effect, but when about 3-wt % of the transition metal is added, the effect can be sufficiently exerted. Furthermore, also in the case that the transition metal is added to an electrolyte, the similar effect can be obtained.

When the Si content contained in the electrode is regulated to 0.07-wt % or less, the dissolution amount of the anode can be decreased 40-wt % as compared with a case where the Si content is not controlled.

When the Si content contained in the electrode is regulated to 0.07-wt % or less and about 0.02-wt % of Co which is the transition metal is contained in the electrode, the dissolution amount of the anode can be decreased about 50-wt % as compared with a case where they are not controlled.

If the amount of the transition metal, which is added to the electrode and the electrolyte, is 0.01-wt % or more, the effect of the present invention can be obtained. However, when the transition metal is added in many large amounts to an electrolyte, there is fear to reduce electrolytic efficiency by pollution of the electrolyte. Therefore, the amount of the transition metal is desirable by 2-wt %. In the case that the Si content contained in the electrode is regulated to 0.07-wt % or less and the transition metal is contained in both of the electrode and the electrolyte, the inhibition effect of anode dissolution can be promoted. When 0.05-wt % of the transition metal is added to the electrode and 0.1-wt % of the same is added to the electrolyte, the dissolution amount of the anode can be decreased about 55-wt % as compared with a case where they are not controlled.

FIG. 1 shows the constitution of an electrolytic cell, which will be described. Cell body 1 and cell lid 2 are constituted so that electrolyte 8 and a generated gas may be separated from the outside of a system. Cell body 1 is usually hermetically connected to cell lid 2 via a gasket to secure airtightness. Additionally, the inside faces of cell body 1 and cell lid 2 may be covered with a fluorocarbon resin, and in such a case, the durability of these members can be further improved.

Anode 3 and cathode 4 are separated by partition 5 attached to lid 2. If $NF_3$ generated from anode 3 is mixed with hydrogen generated from cathode 4, ignition and explosion easily occur. Therefore, in order to prevent this phenomenon, partition 5 is provided. The downward length of partition 5 can be suitably selected under conditions that partition 5 is not excessively close to the bottom of cell body 1 and it extends below the liquid surface of the electrolyte.

The produced $NF_3$ gas and hydrogen gas are respectively discharged from the electrolytic cell to the outside through anode gas vent 6 and cathode gas vent 7 formed in cell lid 2. Moreover, during hydrolysis, an inert gas such as a nitrogen gas may be fed as a carrier gas to both sides of anode 3 and cathode 4. The material for cell body 1, cell lid 2 and partition 5 is usually a metal, but if necessary, a fluorocarbon resin may also be used.

With regard to the exemplified electrolytic cell, its fundamental constitutional requirements have been merely mentioned, and needless to say, the shape of the respective members as well as the arrangement of the electrodes and the partition is optionally selected. The especial electrodes are used, but the electrolytic cell does not have to possess an especial constitution. In addition, the constitution of the electrolytic cell does not have an influence on the effect of the present invention.

As the electrolyte, an ammonium fluoride ($NH_4F$)-hydrogen fluoride (HF)-containing salt is used. Examples of the preparation method of the electrolyte include a preparation from an ammonium gas and anhydrous hydrogen fluoride, a preparation from ammonium monohydrogen difluoride and anhydrous hydrogen fluoride, and a preparation from ammonium fluoride and anhydrous hydrogen fluoride.

The electrolyte can be prepared by, for example, the following procedure. In the case of the preparation from ammonium monohydrogen difluoride ($NH_4HF_2$) and/or ammonium fluoride ($NH_4F$) and anhydrous HF, predetermined amounts of $NH_4HF_2$ and/or $NH_4F$ are first placed in a vessel or the electrolytic cell, and a predetermined amount of anhydrous HF is then blown thereinto.

According to another preparation method, predetermined amounts of an $NH_3$ gas and an NF gas are directly reacted with each other in the vessel or the electrolytic cell to prepare the electrolyte. For the reaction of the $NH_3$ gas and the NF gas, these gases may be fed together with 5 to 70 vol % of a dry inert gas such as nitrogen, argon or helium, and in such a case, the electrolyte does not flow backward through gas feed pipes, so that the electrolyte can be stably prepared. Any method permits the easy preparation of the electrolyte.

With regard to the composition of the electrolyte, a molar ratio of $HF/NH_4F$ is suitably in a range of 1 to 3. If this molar ratio is less than 1, the electrolyte inconveniently tends to bring about thermal decomposition. Conversely, if it is more than 3, the vapor pressure of HF rises, so that a large amount of HF is lost, and owing to this loss, the composition of the electrolyte inconveniently largely fluctuates. The molar ratio of 1 to 3 is suitable, but if higher composition stability is desired, a range of 1.5 to 2.5 is more preferable, and a range of 1.8 to 2.2 is most preferable.

An electrolytic current density is preferably in a range of 1 to 30 $A.dm^{-2}$. The lower limit of the current density has an influence on the productivity of the $NF_3$ gas, and a technical restriction on the current density is scarcely present. Heat generated in the vicinity of the electrode is substantially proportional to the current density. Therefore, if the current density is noticeably high, the temperature of the electrolyte locally rises, so that some inconveniences occur, and for example, the composition of the electrolyte is not stable. Such a high current density does not affect the effect of the present invention, but roughly, the current density is preferably in a range of 1 to 30 A.dm-$^{2}$, more preferably in a range of 5 to 20 A.dm$^{2}$.

As the material for the cathode for use in the electrolysis, there can be used a material such as iron, steel, nickel or Monel which can usually be used in the electrolytic manufacture of the $NF_3$ gas.

Next, the present invention will be described in detail in accordance with examples. It should be noted that % is based on weight.

of a transition metal in an electrolyte were changed as shown in Table 1. The results are shown in Table 1.

COMPARATIVE EXAMPLE 1

The same procedure as in Example 1 was conducted except that a nickel electrode (weight=2304 g) having a purity of 99.3% and an Si content of 0.12% was used. The results are shown in Table 1.

TABLE 1

| | Si Amount (wt %) in Electrode | Transition Metal added to Electrode: Kind | Transition Metal added to Electrode: Amount (wt %) | Transition Metal added to Electrolyte: Kind | Transition Metal added to Electrolyte: Amount (wt %) | Weight of Electrode (g): Original Weight | Weight of Electrode (g): Dissolution Amount of Electrode | Weight of Electrode (g): Dissolution Ratio (%) |
|---|---|---|---|---|---|---|---|---|
| Example 1 | 0.02 | — | — | — | — | 2300 | 97 | 4.2 |
| 2 | 0.07 | Co | 0.05 | — | — | 2300 | 85 | 3.7 |
| 3 | 0.02 | Co | 0.05 | — | — | 2310 | 82 | 3.5 |
| 4 | 0.02 | Co | 0.05 | CoO | 0.15 | 2308 | 72 | 3.1 |
| 5 | 0.04 | Cu | 0.05 | — | — | 2312 | 83 | 3.6 |
| 6 | 0.04 | Cu | 0.05 | Co | 0.1 | 2302 | 70 | 3.0 |
| 7 | 0.07 | Cr | 0.06 | — | — | 2310 | 84 | 3.6 |
| 8 | 0.07 | Ti | 0.04 | — | — | 2298 | 85 | 3.7 |
| 9 | 0.03 | Ti | 0.04 | $TiO_2$ | 0.05 | 2296 | 71 | 3.1 |
| 10 | 0.02 | Zr | 0.08 | — | — | 2292 | 82 | 3.6 |
| 11 | 0.02 | Nb | 0.08 | — | — | 2301 | 81 | 3.5 |
| 12 | 0.03 | Mn | 0.05 | $ZrO_2$ | 0.1 | 2318 | 72 | 3.1 |
| Comp. Ex. | 0.12 | — | — | — | — | 2304 | 161 | 7.0 |

EXAMPLE 1

First, ammonia was mixed with anhydrous hydrogen fluoride to prepare 20 kg of an ammonium fluoride ($NH_4F$)-hydrogen fluoride (HF)-containing molten salt having a molar ratio ($HF/NH_4F$) of 1.7, and the salt was then placed in a 20-liter electrolytic cell made of a fluorine contained resin. In this fluorine contained resin electrolytic cell, there was set a nickel alloy electrode (weight=2300 g) in which an Si content was regulated to 0.02%, followed by carrying out electrolysis. After the electrolysis was done at a temperature of 120° C. and a current density of 10 A.dm$^{-2}$ for 100 hours, the weight of an anode was measured. As a result, the dissolution amount of the anode was 97 g (dissolution ratio 4.2%).

EXAMPLE 2

First, ammonia was mixed with anhydrous hydrogen fluoride to prepare 20 kg of an ammonium fluoride ($NH_4F$)-hydrogen fluoride (HF)-containing molten salt having a molar ratio ($HF/NH_4F$) of 1.7, and the salt was then placed in a 20-liter electrolytic cell made of a fluorine contained resin. In this fluorine contained resin electrolytic cell, there was set a nickel alloy electrode (weight=2300 g) in which an Si content was regulated to 0.07% and Co was contained in a ratio of 0.05%, followed by carrying out electrolysis by the same procedure as in Example 1. Afterward, the weight of an anode was measured, and as a result, the dissolution amount of the anode was 85 g (dissolution ratio=3.7%).

EXAMPLES 3 TO 12

The same procedure as in Example 1 was conducted except that an Si content and a kind and amount of a transition metal in an electrode as well as a kind and amount

What is claimed is:

1. An electrode and an electrolyte comprising an ammonium fluoride ($NH_4F$)-hydrogen fluoride (HF)-containing molten salt and having a composition ratio ($HF/NH_4F$) of 1 to 3 to prepare a nitrogen trifluoride gas, wherein said electrode comprises nickel in which an Si content is 0.07 wt % or less.

2. The electrode according to claim 1 wherein at least one of transition metals other than nickel is added to the electrode.

3. The electrode according to claim 2 wherein the transition metal is selected from the group consisting of first transition elements (Sc, Ti, V, Cr, Mn, Fe, Co and Cu) and second transition elements (Y, Zr, Nb, Tc, Ru, Rh, Pd and Ag) among elements in the groups IIIA to IB of the periodic table (long form), Ta, Pt, Au, and oxides and peroxides which are compounds of these transition metals.

4. The electrode according to claim 2 wherein the content of the transition metal is 0.01 wt % or more.

5. A preparation method of a nitrogen trifluoride gas comprising the step of electrolyzing an electrolyte comprising an ammonium fluoride ($NH_4F$)-hydrogen fluoride (HF)-containing molten salt and having a composition ratio ($HF/NH_4F$) of 1 to 3 by the use of a nickel electrode as an anode to prepare a nitrogen trifluoride gas, wherein 0.01 wt % to 2 wt % of at least one of transition metals other than nickel is added to the electrolyte.

6. The preparation method of the nitrogen trifluoride gas according to claim 5 wherein the nickel electrode is an electrode comprising an ammonium fluoride ($NH_4F$)-hydrogen fluoride (HF)-containing molten salt having a composition ratio ($RF/NH_4F$) of 1 to 3 wherein said electrode comprises nickel in which an Si content is 0.07 wt % or less.

7. The preparation method of the nitrogen trifluoride gas according to claim 6 wherein at least one of transition metals other than nickel is added to the electrode.

8. The preparation method of the nitrogen trifluoride gas according to claim 7 wherein the transition metal is selected from the group consisting of first transition elements (Sc, Ti, V, Cr, Mn, Fe, Co and Cu) and second transition elements (Y, Zr, Nb, Tc, Ru, Rh, Pd and Ag) among elements in the groups IIIA to IB of the periodic table (long form), Ta, Pt, Au, and oxides and peroxides which are compounds of these transition metals.

9. The preparation method of the nitrogen trifluoride gas according to claim 8 wherein the content of the transition metal is 0.01 wt % or more.

* * * * *